US006296449B1

(12) United States Patent
Wang

(10) Patent No.: US 6,296,449 B1
(45) Date of Patent: Oct. 2, 2001

(54) MULTIPLE CURRENT SAFETY FAN

(76) Inventor: Pierce Wang, No. 46, Alley 26, Lane 667, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/553,058

(22) Filed: Apr. 20, 2000

(51) Int. Cl.[7] ..... F04D 29/70
(52) U.S. Cl. ..... 416/247 R
(58) Field of Search ..... 416/246, 247 R; 415/126, 127

(56) References Cited

U.S. PATENT DOCUMENTS

| | | | | |
|---|---|---|---|---|
| 1,541,236 | * | 6/1925 | Schmelzer | 416/247 R |
| 4,022,548 | * | 5/1977 | McLarty | 416/247 R |
| 4,222,318 | * | 9/1980 | Patton et al. | 416/247 R X |
| 4,239,459 | * | 12/1980 | Felter | 415/126 X |
| 5,295,811 | * | 3/1994 | Chiu | 416/247 R X |
| 5,613,833 | * | 3/1997 | Wolfe et al. | 416/247 R X |
| 6,045,330 | * | 4/2000 | Williams | 416/247 R |
| 6,099,258 | * | 8/2000 | Litvin et al. | 416/247 R |

FOREIGN PATENT DOCUMENTS

| | | | | |
|---|---|---|---|---|
| 57-179523-A | * | 11/1982 | (JP) | 416/247 R |
| 62-243991-A | * | 10/1987 | (JP) | 416/247 R |

* cited by examiner

*Primary Examiner*—John E. Ryznic
(74) *Attorney, Agent, or Firm*—Bacon & Thomas, PLLC

(57) ABSTRACT

The present invention relates to a multiple current safety fan, which comprises a body; a motor seat installed in the body, the two sides of the body being separately installed with a locking hole; two screen covers separately installed on the front side and the rear side of the body, the screen covers being annularly and outwardly installed with a plurality of ribs, and the screen covers being reinforced by reinforcing ribs having a U-shape and installed in crisscross. The screen cover on the rear side or the body is indented inwardly. and the interior At the center part of the screen cover is connected to the motor seat inside the body. The leg seat is fastened to the locking holes on the two sides of the body, and the two ends thereof are protruded with two supports. The supports are installed with a plurality of perforated adjustment holes so that the locking holes of the body and the adjustment holes of the supports are used to adjust the height of the body of the electric fan.

4 Claims, 7 Drawing Sheets

MULTIPLE CURRENT SAFETY FAN

BACKGROUND OF THE INVENTION

The present invention relates to a fan, more particularly an improved fan with an adjustable fan speed, an adjustable height and a protected motor.

Taiwan is an island such that it has a pacific island type weather with distinct four seasons. Summer in Taiwan is hot and humid. Therefore, most families in Taiwan use an air conditioner or a fan to cope with the hot weather in summer. Although an air conditioner provides a cool and comfortable environment, the power consumption of an air conditioner is significant and frequent use of the air conditioner tends to cause a user to develop symptoms such as rheumatism, aches and pains, etc. Moreover, some people choose to use a fan. An electric fan consumes less power, and is easy to move around to blow away the hot air indoors.

Conventional electric fans known on the market are shown in FIG. 1 and FIG. 2. However, conventional electric fans have many drawbacks in use:

1. The screen on the rear side of the main body protrudes outwards and the inside of the screen is connected to a motor.

Therefore, if an electric fan falls down backwards, the screen is liable to suffer from an impact and subsequently damage the motor, thereby reducing the operation life of the fan.

2. The height of the main body of an electric fan is not adjustable thereby causing an inconvenience in use.

Therefore, the inventor of the present invention performs many researches to make improvements over the known drawbacks existing in a conventional electric fan and proposes an improved fan of the present invention.

SUMMARY OF THE INVENTION

The main objective of the present invention is to provide a multiple current safety fan, which comprises a screen inwardly installed on the rear side off a body in order to protect the motor seat inside the screen.

Another objective of the present invention is to provide a multiple current safety fan with an adjustable body height for the convenience in use and a changeable shape of the fan blade for providing various wind speed and flow and increasing the application value of the fan.

In order to achieve the above-mentioned objectives, the implementation techniques of the present invention include: The inside of the body is installed with a motor seat, and the two sides of the body are separately installed with a locking hole. Two fan screen covers are separately installed on the front side and the rear side of the body. The fan screen covers are installed with a plurality of ribs arranged annularly and outwardly gradually. The fan screen covers are installed with U-shape reinforcing ribs installed in a crisscross shape. The screen cover on the rear side of the body is inwardly installed, and the interior at the center of the screen cover is connected to a motor seat inside the body. A leg seat is fastened to the locking holes on the two sides of the body and is protruded with two supports on the two ends thereof. The supports are installed with a plurality of perforated adjustment holes for adjusting the body height of the electric fan through the locking holes of the body and the adjustment holes of the supports.

DETAILED DESCRIPTION OF THE PREFERRED EMBODIMENT

Figure 1:
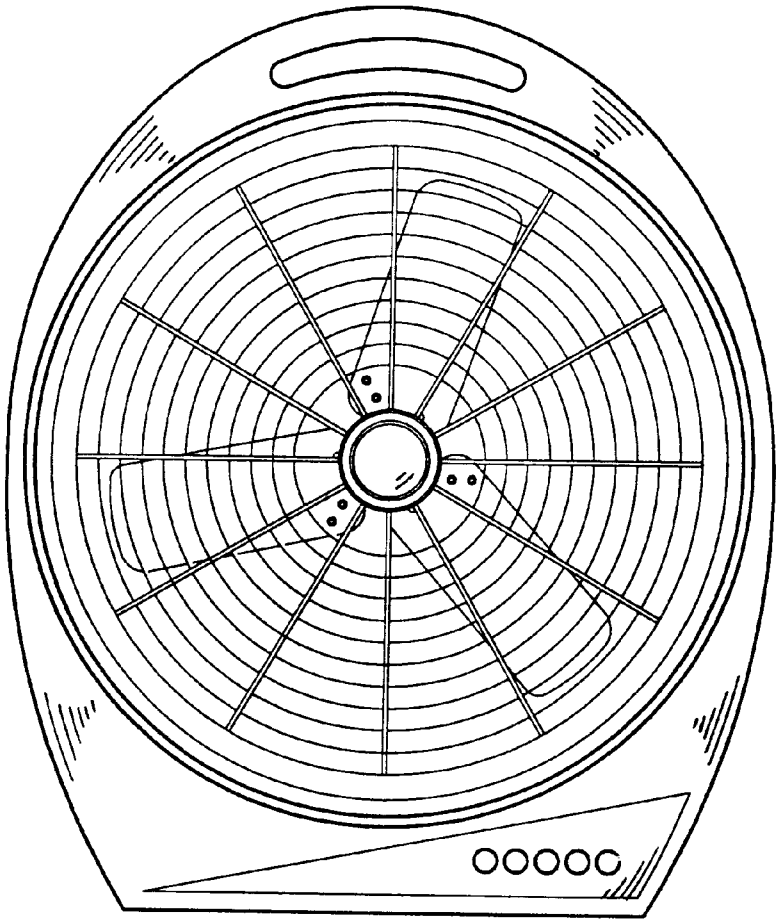
PRIOR ART Fig. 1
FIG. 1 is the plain view of a conventional fan.
Figure 2:
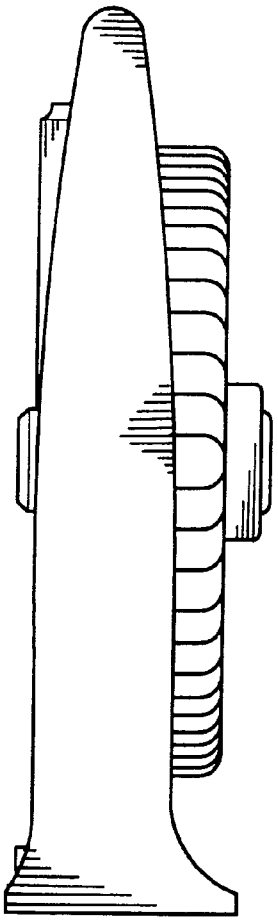
PRIOR ART Fig. 2
FIG. 2 is a side view of a conventional fan.
Figure 3:
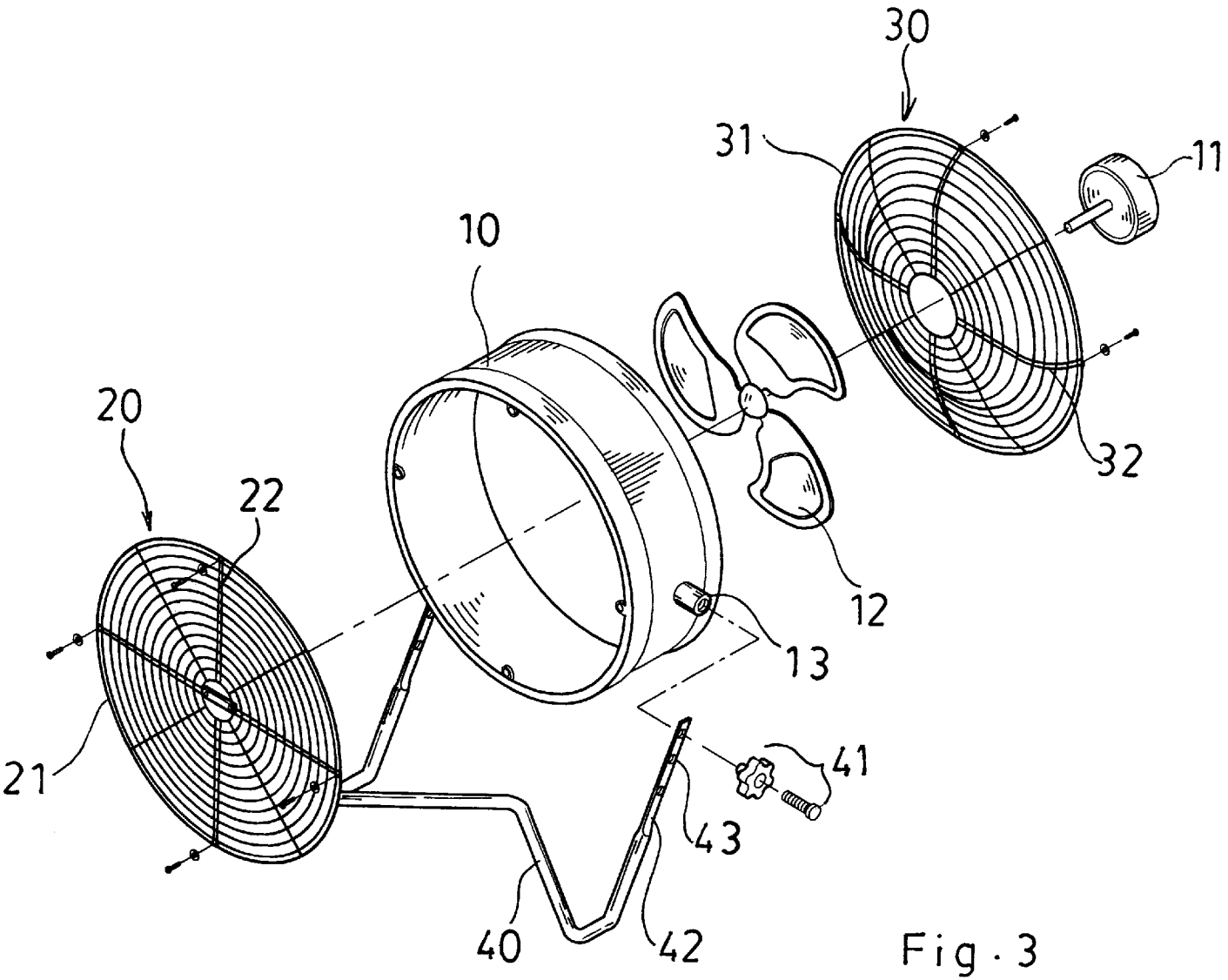
FIG. 3 is a 3-D exploded view of a fan according to the present invention.
Figure 4:
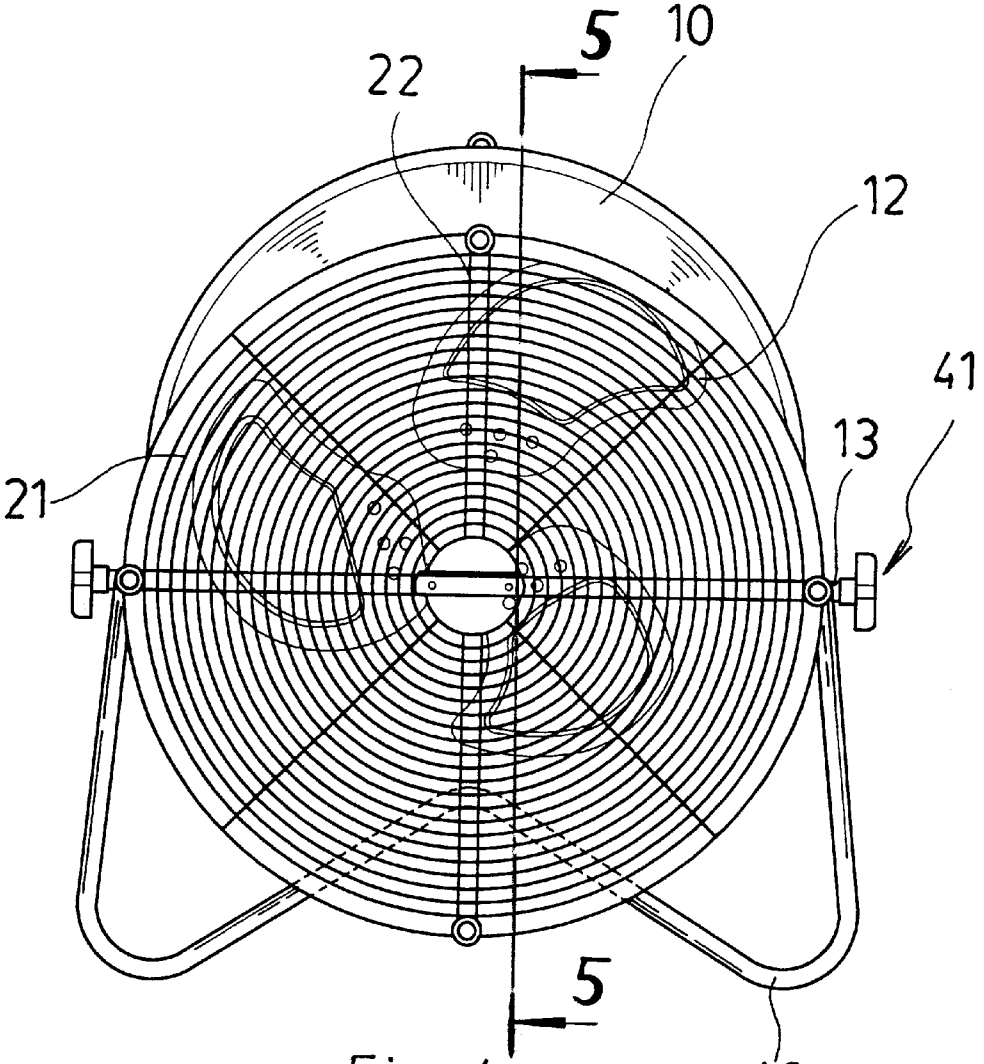
FIG. 4 is a 3-D assembly of a fan according to the present invention.

First, please refer to FIG. 3 and FIG. 4:

The present invention relates to a multiple current safety fan, which mainly comprises:

a body 10 being of a spherical shape and installed with a motor seat 11 therein, the motor seat 11 being installed with fan blades at an identical space for generating a wind flow through rotating the fan blades 12 by the motor seat 11, and the two sides of the body 10 being separately protruded with a locking hole 13; two screen covers 20, 30 separately fastened to the front side and the rear side of the body 10, and installed with a plurality of ribs 21, 31 surrounding thereon, and added with U-shape reinforcing ribs 22, 32 in crisscross such that the U-shape reinforcing ribs 22, 32 on the screen covers 20, 30 can increase the impact resistance of the electric fan, and the screen cover 30 on the rear side of the body 10 is inwardly installed where the interior at the center portion thereof is connected to the motor seat 11 inside the body 10;

a leg seat 40 fastened on the locking holes 13 on the two sides of the body 10 through a fastening element 41, the leg seat 40 having an approximately n-shape bottom and the two ends of which being upwardly protruded with two supports 42 which are installed with a plurality of perforated adjustment holes 43 for the adjustment of the height of the body 10 of the electric fan through the locking holes 13 of the body 10 and the adjustment holes 43 of the supports 42.

Figure 5:
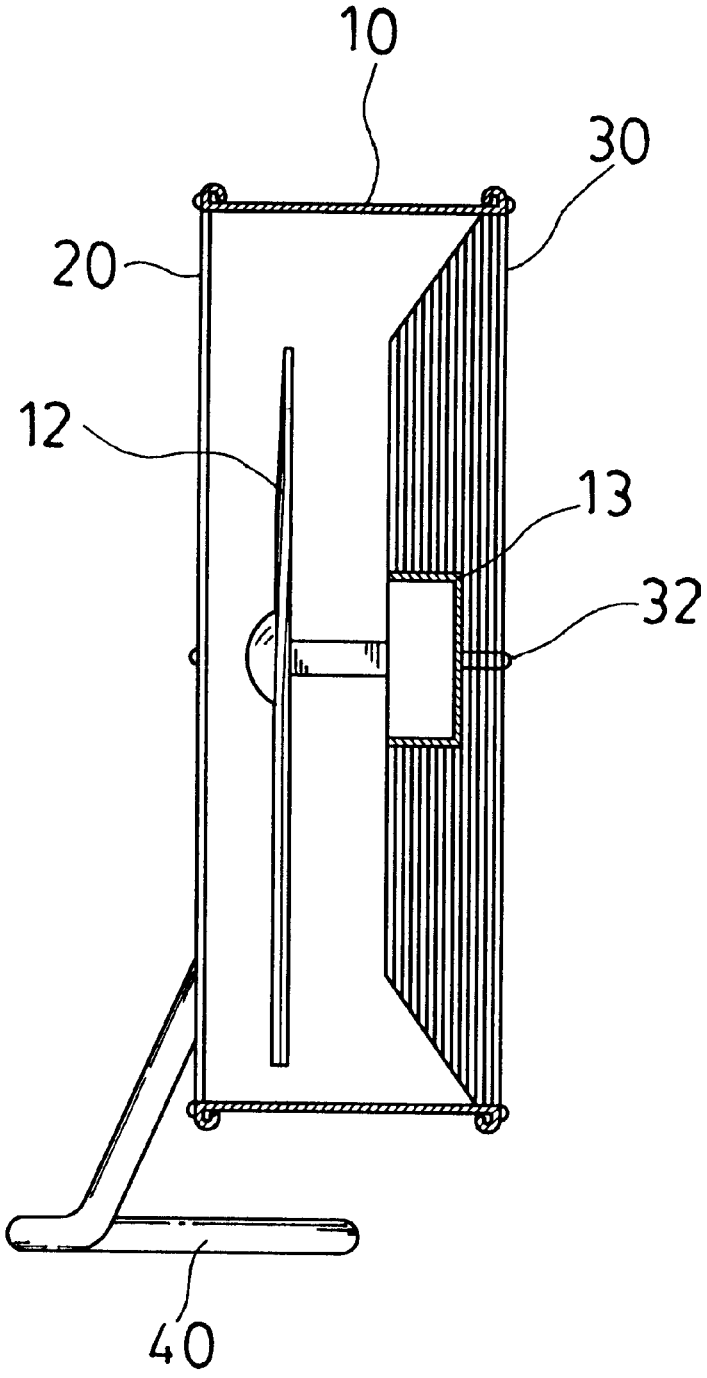
FIG. 5 is a 5—5 section view of FIG. 4.
Figure 6:
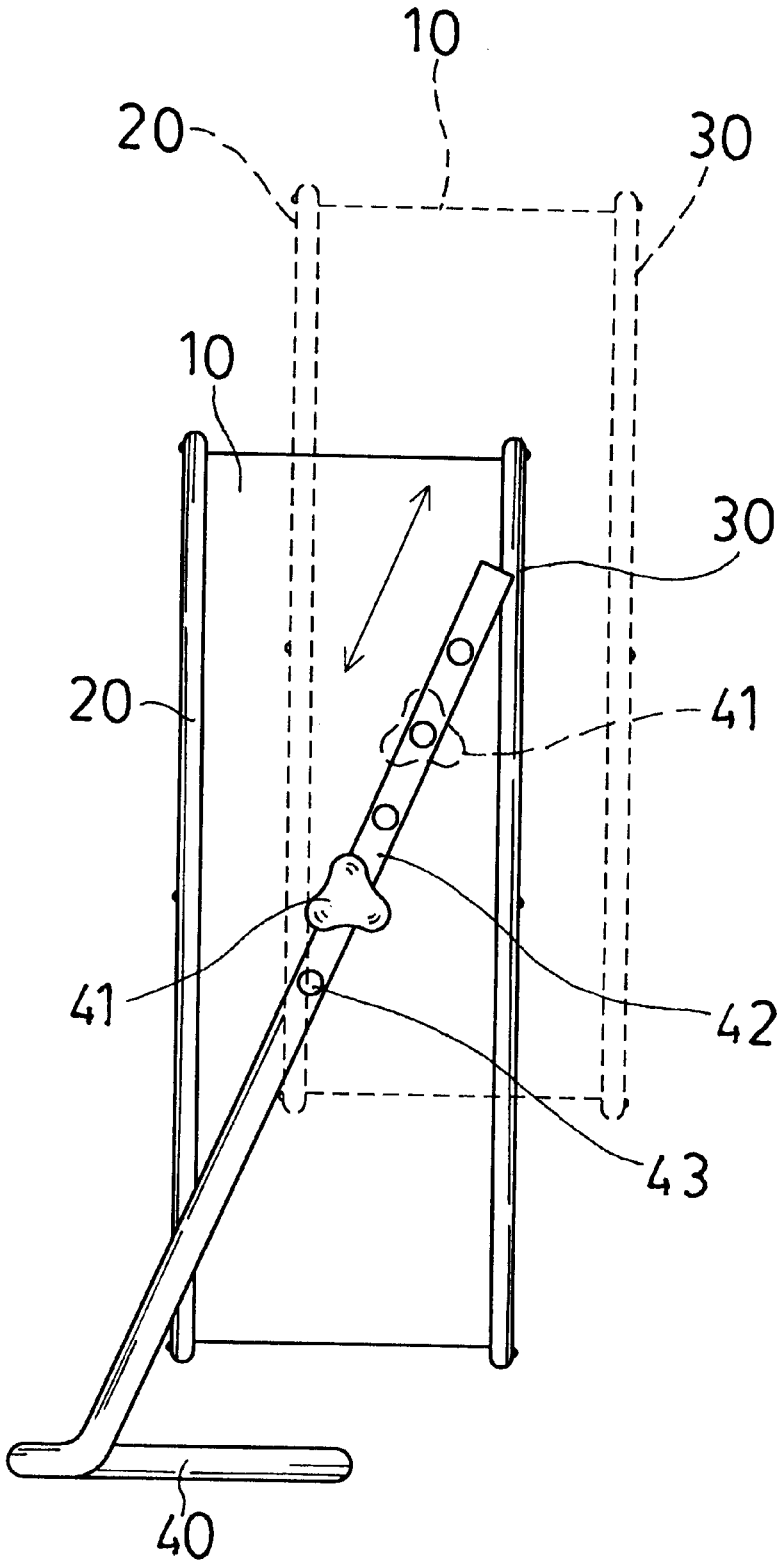
FIG. 6 is a schematic diagram for the movement of the leg seat according to the present invention.
Figure 7:
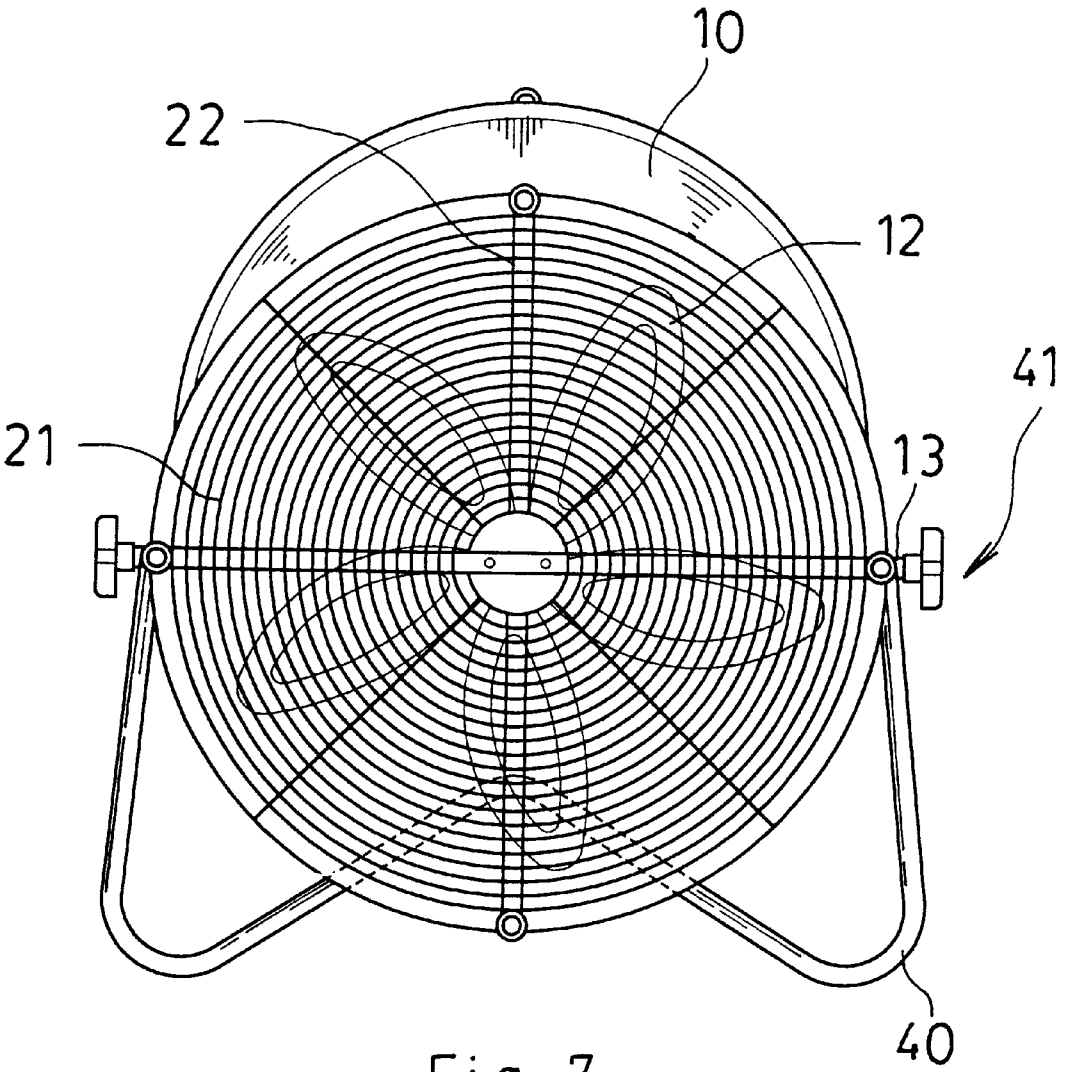
FIG. 7 is another embodiment of the present invention.
Figure 8:
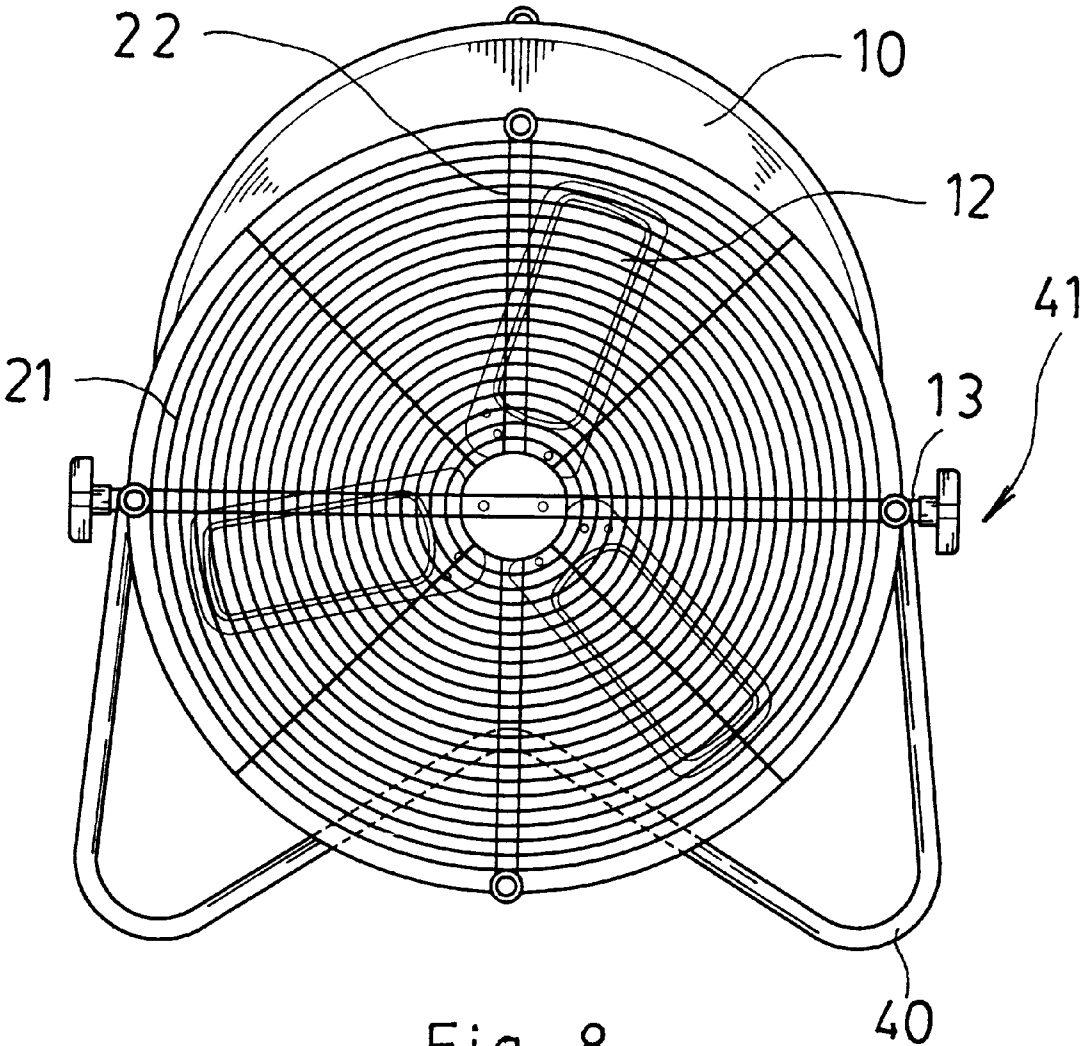
FIG. 8 is still another embodiment of the present invention.

Through the use of the above-mentioned components, the present invention has the following functions:

The screen cover 20 on the rear side of the body 10 of the electric fan is indented inwardly, as shown in FIG. 5, which is the key feature of the present invention. Since the motor seat 11 is installed on the inside at the central indent of the screen cover 30, the motor seat 11 can avoid damage from a direct impact ,when the electric fan falls down backwards. Whereas in a conventional electric fan, the screen cover at the rear side of the body is protruded outwardly and the central interior thereof is connected to a motor. Therefore, the motor will receive a direct impact when the body of a conventional electric fan falls down backwards, thereby causing a correspondingly lower operation life of the electric fan. Therefore, please refer to FIG. 6 to FIG. 8, the motor seat 11 according to the present invention is closer to the screen cover 20 on the front side of the body 1O, such that the wind flow from the fan blades 12 on the motor seat is stronger than that from the fan blades of a conventional electric fan. Furthermore, the shape of the fan blades 12 according to the present invention can be changed according to the actual need thereby obtaining a different current. Moreover, the two screen covers 20, 30 according to the present invention are installed with reinforcing ribs 22, 32 having an approximately U-shape and installed crisscross. Through the use of the reinforcing ribs 22, 32, an electrical fan according to the present invention is sturdier and more durable than a conventional electric fan.

Furthermore, as showing in FIG. 5, through the locking holes 13 on the two sides of the body 10 and plural adjustment holes 43 on the supports 42 on the two ends of the leg seat 40, a fastening element can be used to selectively lock the body 10 of the electric fan on an arbitrary adjustment hole 43 on the support 42, thereby optionally adjusting the height of the body 10 of the electric fan.

What is claimed is:

1. A multiple current safety fan, comprising:

a body spherical in shape; two screen covers separately installed on the front side and the rear side of the body, the screen covers being annularly installed with a plurality of ribs;

a motor seat installed on the screen cover on the rear side of the body, the other end of the motor being installed with fan blade;

leg seat fastened on the two sides of the body through a fastening element, the leg seat having an approximately n-shape bottom and the two ends of which being upwardly and protrudedly installed with two supports; characterized in that:

the screen cover on the rear side of the body is installed inwardly, and the indent being connected to the motor seat, thereby providing a protection to the motor seat by the inwardly installed screen cover.

2. The multiple current safety fan as claimed in claim 1 wherein the two sides of the seat body are installed with locking holes, and the supports of the leg seat are installed with a plurality of perforated adjustment holes.

3.The multiple current safety fan as claimed in claim 1 wherein the two screen covers are installed with reinforcing ribs having an approximately U-shape and installed in crisscross.

4. The multiple current safety fan as claimed in claim 1 wherein the fan blades connected to the motor seat can be designed into rhomboid or rectangular.

* * * * *